US007946378B2

(12) United States Patent
Windischberger et al.

(10) Patent No.: US 7,946,378 B2
(45) **Date of Patent: *May 24, 2011**

(54) MEMBRANE FOR AN ELECTROACOUSTIC TRANSDUCER

(75) Inventors: Susanne Windischberger, Vienna (AT); Helmut Wasinger, Hinterbruehl (AT); Josef Lutz, Rohrau (AT)

(73) Assignee: NXP B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/889,120

(22) Filed: Sep. 23, 2010

(65) Prior Publication Data

US 2011/0019866 A1 Jan. 27, 2011

Related U.S. Application Data

(63) Continuation of application No. 11/915,543, filed as application No. PCT/IB2006/051592 on May 19, 2006.

(30) Foreign Application Priority Data

May 25, 2005 (EP) ..... 05104476

(51) Int. Cl.
*G10K 13/00* (2006.01)

(52) U.S. Cl. ..... 181/157; 181/164; 181/166; 181/172; 181/173; 181/174

(58) Field of Classification Search ..... 181/157, 181/166, 174, 172, 173
See application file for complete search history.

(56) References Cited

U.S. PATENT DOCUMENTS

| | | | | |
|---|---|---|---|---|
| 1,990,409 | A | 2/1935 | Lawrance | |
| 2,662,606 | A | 12/1953 | Hurley | |
| 6,920,957 | B2 * | 7/2005 | Usuki et al. | 181/173 |
| 2007/0209866 | A1 * | 9/2007 | Frasl et al. | 181/157 |

FOREIGN PATENT DOCUMENTS

| | | | |
|---|---|---|---|
| EP | 1 515 582 | A1 | 3/2005 |
| FR | 2 282 203 | A1 | 3/1976 |
| GB | 1 488 541 | A | 10/1977 |
| JP | 59-17798 | A | 1/1984 |
| JP | 9-224297 | A | 8/1997 |
| JP | 2000-278790 | A | 10/2000 |
| WO | 2005-015949 | A1 | 2/2005 |

OTHER PUBLICATIONS

International Search Report for Int'l Patent Appln. PCT/IB2006/051592 (Dec. 3, 2004).
Extended European Search Report for European Patent Appln. No. 10167414.1 (Oct. 4, 2010).

* cited by examiner

*Primary Examiner* — Elvin Enad
*Assistant Examiner* — Forrest M Phillips

(57) ABSTRACT

A membrane for an electroacoustic transducer is disclosed having a first area, a second area, which is arranged for translatory movement in relation to said first area, and a third area, which connects said first area and said second area, wherein local, planar spring constants along a closed line within said third area encompassing said second area, are determined in such a way that local, translatory spring constants along said line in a direction of said translatory movement are substantially constant or exclusively have substantially flat, mutual changes.

15 Claims, 5 Drawing Sheets

MEMBRANE FOR AN ELECTROACOUSTIC TRANSDUCER

CROSS-REFERENCE TO RELATED APPLICATIONS

This application is a continuation of copending U.S. patent application Ser. No. 11/915,543, filed on Nov. 26, 2007, which is the national stage of international patent application no. PCT/IB2006/051592, filed on May 19, 2006, the contents of each of which are incorporated by reference herein.

This application claims the priority under 35 U.S.C. §119 of European patent appln. no. 05104476.6, filed on May 25, 2005, the contents of which are incorporated by reference herein.

FIELD OF THE INVENTION

The invention relates to a membrane for an electroacoustic transducer having a first area, a second area, which is arranged for translatory movement in relation to said first area, and a third area, which connects said first area and said second area. The invention furthermore relates to a transducer comprising an inventive membrane and a device comprising an inventive transducer.

BACKGROUND OF THE INVENTION

The ever decreasing size and increased complexity of current devices lead to certain consequences for an inbuilt transducer. To optimize the ratio between space needed inside the device and sound-emanating area, speakers are more and more rectangular or oval instead of circular for example. Whereas circular speakers are fully symmetrical, rectangular and ovals speakers comprise some asymmetries which in turn lead to poor sound quality, which is to improved.

FIGS. 1*a* and 1*b* show a first (left half) and a second (right half) embodiment of a rectangular prior art speaker 1 with rounded corners, FIG. 1*a* in top view, FIG. 1*b* in a cross-sectional view. Speaker 1 comprises a membrane 2, a coil 3 attached to said membrane 2, a magnet system 4 interacting with coil 3 and a housing 5 for carrying aforesaid parts. The membrane 2 of the second embodiment additionally comprises corrugations 6.

The membrane 2 is divided into a first area A1, a second area A2, which is arranged for translatory movement in relation to said first area A1, and a third area A3, which connects said first A1 and said second area A2. Furthermore, a closed line L is shown, which is arranged within said third area A3 and encompasses said second area A2. As said line L is parallel to the outer border of the rectangular speaker 1 with rounded corners or the identically shaped membrane 2 respectively, it comprises four straight sections a with four curved sections b in-between. Furthermore, two directions are shown in FIGS. 1*a* and 1*b*. First, a direction of translatory movement DM, which is parallel to the axis of the speaker 1 and which indicates the direction of movement of said second area A2. Second, a direction DL of said line L, which is obvious for the straight sections a and which is the tangent to said line L in the curved sections b. Line direction DL and translatory movement direction DM are perpendicular to each other in each point of said line L. FIGS. 1*a* and 1*b* only show 2 examples of such pairs, one situated in a straight section a and one in a curved section b (not shown in FIG. 1*b*).

The first area A1 in the present example is the border of the membrane 2, which is connected to the housing 5 and therefore immovable with respect to the housing 5. Said second area A2 is the area inside the outer border of coil 3 in the present example. Second area A2 therefore covers the joint face between coil 3 and membrane 2 as well as the so-called dome. Said second area A2 may translatorily move in relation to first area A1. Other movements, which occur in a real and thus non-ideal speaker, such as rocking, bending and a certain side movement are disregarded for the further considerations. Second area A2 is therefore considered to move as a whole, which means that it does not change its shape.

Third area A3 now connects said first A1 and said second area A2. Since said second area A2 moves in relation to said first area A1, said third area A3 changes its shape. In the straight sections a there is a simple rolling movement, which means that there are no movements in line direction DL inside the membrane 2. A completely different situation exists in the curved sections b. Here a movement of the membrane 2 in translatory movement direction DM causes a relative movement in line direction DL inside the membrane 2. This relative movement is caused by a change of radius of the curved sections b which in turn is caused by the translatory movement of second area A2.

The problem addressed is well known in the prior art, why usually corrugations 6 as the second embodiment of speaker 1 has are put in the curved sections b so as to allow aforesaid relative movement in line direction DL. The exact physical explanation is, that the planar spring constant psc, which is in line direction DL, has decreased. So normally the planar spring constant psc in a curved section b is lower than in a straight section a. However, it has been found out that simply putting corrugations 6 into curved sections b is not sufficient for a satisfying function of a speaker, which is explained in more detail in the following section.

Reference is therefore made to FIG. 2*a*, which shows a graph of the planar spring constant psc and the translatory spring constant tsc of aforesaid prior art membranes 2 along a quarter of said line L, hence sweeping half of a straight section a of the long side of membrane 2, a curved section b, and half of a straight section a of the small side of the membrane 2. The planar spring constant psc is in line direction DL and the translatory spring constant tsc is in translatory movement direction DM as mentioned before.

The solid lines show parameters for the first embodiment of the prior art membrane 2 with no corrugations. Here the planar spring constant psc is more or less constant provided that the membrane 2 is homogeneous. As a result, the translatory spring constant tsc is dramatically increased in the corners of the membrane 2 or in the curved sections b respectively which in turn leads to some unwanted consequences:

- warping of membrane 2, which in turn leads to distorted sound reproduction as well as to increased local loads on the coil 3. This might damage the coil 3, in particular in case of a so-called self supporting coil;
- decreased stroke of membrane 2, which in turn leads to reduced volume or poor efficiency respectively;
- local peak loads within membrane 2, which in turn leads to buckling or breaking of membrane 2.

The dashed lines now show parameters for the membrane 2 having corrugations 6 in the curved sections b. Thus the planar spring constant psc shows a step down in the curved section b. The corrugations 6 are well designed, so that the translatory spring constant tsc in the middle of the curved section b has the same value as in the straight sections a. So one could believe that the problem is solved therewith, which was obviously a doctrine in speaker design. However, there is an unpredictable rise and drop in the graph of the translatory spring constant tsc at the border between the straight sections a and curved sections b, which again leads to the addressed consequences. This is because of the interaction between the straight sections a and curved sections b. If the third area A3 is theoretically split into separate straight sections a and curved sections b, the associated deformations will be different when the second area A2 moves. But because the straight sections a and the curved sections b are interconnected at their edges, said interaction and in turn an influence of the translatory spring constant tsc occur. More recent investigations have revealed this unwanted effect.

It should be noted that there are some further embodiments of prior art membranes comprising complex structures of bulges and corrugations in different embodiments, which are difficult to manufacture and which do not sufficiently solve the objects addressed above either.

OBJECT AND SUMMARY OF THE INVENTION

It is an object of the invention to provide a membrane of the type mentioned in the first paragraph and a transducer of the type mentioned in the first paragraph, and a device of the type mentioned in the first paragraph which obviate the drawbacks described hereinbefore.

To achieve the object described above, a membrane for a transducer as characterized in the opening paragraph is disclosed, wherein local, planar spring constants along a closed line, which is arranged within said third area encompassing said second area, each in the direction of said line are determined in such a way that local, translatory spring constants along said line each in a direction of said translatory movement are substantially constant or exclusively have substantially flat, mutual changes.

The object of the invention is further achieved by a transducer comprising an inventive membrane and by a device comprising an inventive transducer.

In this way the performance of a membrane is dramatically increased. Since there are no or no substantial changes of the translatory spring constant along aforesaid line, the warping of the membrane is decreased, the stroke of the membrane is improved, and local peak loads on the membrane are avoided which results in improved sound reproduction, improved efficiency and improved lifetime.

More recent investigations have surprisingly shown, that simply putting corrugations in the curved sections of a membrane only is not sufficient for a satisfactory quality of a transducer. With various experiments and computer simulations it has been found, that there are unexpected differences of the translatory spring constants, even when the membrane comprises corrugations in its curved sections. This is even the case when said corrugations would provide satisfactory performance for a circular membrane, meaning that cutting a circular membrane with a perfect arrangement of corrugations in four quarters and putting them in the corners of a rectangular membrane with rounded corners does not lead to a perfect rectangular membrane.

It is advantageous, when said local, planar spring constants along each closed line, which is arranged within said third area encompassing said second area, each in the direction of said line are determined in such a way that local, translatory spring constants along said line each in a direction of said translatory movement are substantially constant or exclusively have substantially flat, mutual changes. Here the inventive characteristics are applied to the whole third area, meaning that the translatory spring constants are equalized over the whole third area. Hence the performance of the membrane is further improved.

An advantageous embodiment of the membrane is achieved, when the ratio between the highest translatory spring constant and the lowest translatory spring constant does not exceed 1.5. A further advantageous limit for said ratio is 1.3. Finally, it is very advantageous, when said ratio does not exceed 1.1. In this way the translatory spring constants are held within a certain bandwidth, thus allowing certain variations around a constant value. Therefore the design of a membrane is simplified, since the requirements are less strict.

A further advantageous embodiment of the membrane is achieved when a relative translatory spring constant is defined as the ratio between a translatory spring constant and the lowest translatory spring constant, wherein the relative length is defined as the ratio between a length and the total length of said line, and wherein a differential slope of said relative translatory spring constant over said relative length does not exceed 100. A further advantageous limit for said differential slope is 50. Finally, it is very advantageous, when said differential slope does not exceed 20 in any point of said line. In this way the difference between adjacent translatory spring constants is held within a certain bandwidth, thus allowing only slow changes. Therefore, steps or fast changes of the translatory spring constants along said line are avoided, which results in reduced peak loads within the membrane and in turn to a longer life time. It should be noted at this point that the aforesaid limits are related to the macroscopic graph of the translatory spring constant. A possibility to generate a "macroscopic graph" is to take discrete values of translatory spring constant, for instance in the middle of each corrugation, that is to say, at its highest point and to interpolate values in between. But it is also imaginable to determine the differential slope by means of two adjacent discrete values.

It is of advantage, when said line is substantially parallel to the border of said third area. Therefore, a simple definition of the location of the line is given and a homogeneous load on the coil (when considering the border with the second area) and/or on the housing (when considering the border with the first area) is achieved at the same time.

It is further advantageous, when said third area is ring-shaped and said line is the centerline of said third area. This is an additional simple definition of the line, also achieving homogeneous loads on the coil as well as on the housing.

A very advantageous embodiment of an inventive membrane is achieved, when said planar spring constants are determined by variation of a thickness of said membrane. This is an easy measure to achieve equalized translatory spring constants, as a rectangular membrane for example usually has to be softer in the corners and as a membrane more or less automatically gets thinner in the corners during the ironing process. But also besides this particular example of controlling the thickness is an advantageous parameter to achieve the inventive object, in particular when a membrane is die cast.

A very advantageous embodiment of an inventive membrane is further achieved when said membrane comprises corrugations, wherein said planar spring constants are determined by variation of shape of said corrugations. Corrugations are quite common means for allowing elongation and compression of the membrane in curved sections. Therefore, it is comparably easy to adapt the well known corrugations to the inventive object. In most cases corrugations alone are sufficient to achieve equalized translatory spring constants, so that additional structures such as bulges may be avoided, which significantly simplifies the manufacturing of a membrane, in particular the manufacturing of a corresponding mold.

Yet another very advantageous embodiment is achieved when said planar spring constants are determined by variation of depth, density, length, radius, and/or width of said corrugations. These are advantageous parameters of a corrugation to influence the planar spring constant of a membrane or its compliance respectively. The deeper, the longer, and the denser corrugations are the more compliant a membrane is, meaning that its planar spring constant is reduced. In contrast, a membrane is stiffer, meaning that its planar spring constant is increased, the wider a corrugation or the greater the radius at the bends of a corrugation is.

Finally, it is of particular advantage when said line comprises straight sections and curved sections and wherein said variation of said corrugations or of said membrane is situated in said curved sections as well as at least partly in said straight sections. It has been found out that it is not sufficient for a satisfactory quality of a membrane to put corrugations only in the curved sections or to make the membrane thinner therein. These measures rather have to extend into the straight sections, which is very surprising, because in the straight sections there is a simple rolling movement, which means that there is no relative movement in line direction within the membrane, as already stated above. Hence prior art transducers do not comprise corrugations in the straight sections since this is not necessary due to kinematic reasons and since corrugations in straight section rather hinder the rolling movement. Contrary to the known doctrine it has been found out that corrugations advantageously extend into straight sections due to mechanical reasons.

These and other aspects of the invention are apparent from and will be elucidated with reference to the embodiments described hereinafter.

BRIEF DESCRIPTION OF THE DRAWINGS

The invention will be described in greater detail hereinafter, by way of non-limiting example, with reference to the embodiments shown in the drawings.

Figure 1A:
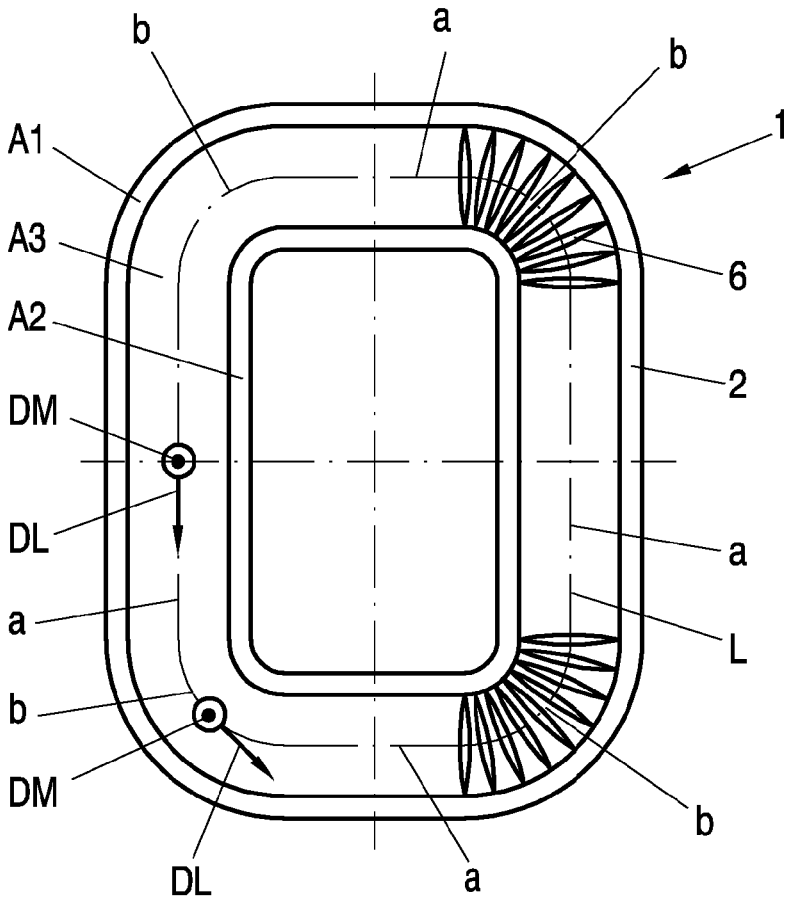
FIG. 1a (prior art)
FIGS. 1*a* and 1*b* show two embodiments of rectangular prior art speakers.
Figure 1B:
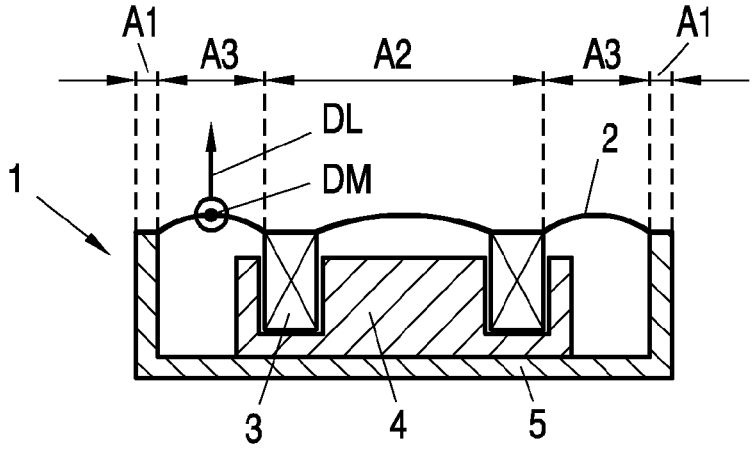
FIG. 1b (prior art)

The Figures are schematically drawn and not true to scale, and the identical reference numerals in different figures refer to corresponding elements. It will be clear for those skilled in the art that alternative but equivalent embodiments of the invention are possible without deviating from the true inventive concept, and that the scope of the invention will be limited by the claims only.

DESCRIPTION OF EMBODIMENTS

Figure 5A:
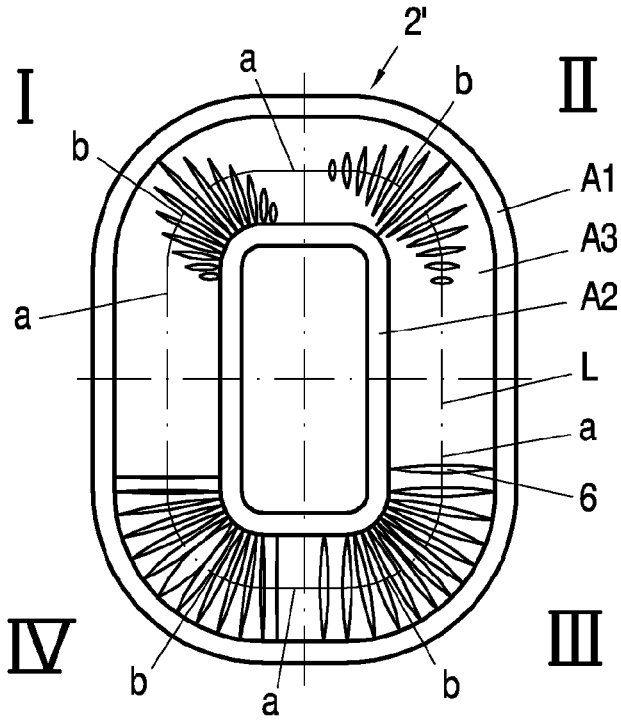
FIG. 5*a* shows four embodiments of an inventive membrane.

FIG. 5*a* shows a first set of four possible embodiments of an inventive membrane 2' comprising corrugations 6, each embodiment in one of four quadrants I to IV. In a first quadrant I the length of corrugations 6 is varied, wherein all corrugations 6 start at the inner border of third area A3. In a second quarter II again the length of corrugations 6 is varied, but in contrast to the first embodiment the corrugations 6 are arranged in the middle of third area A3. In a third quadrant III the density of identical corrugations 6 is varied. Finally, the width of equally spaced corrugations 6 is varied in a fourth quadrant IV. It should be noted that the corrugations 6 are not arranged in the curved section b only, but also extend into the straight sections a.

Figure 5B:
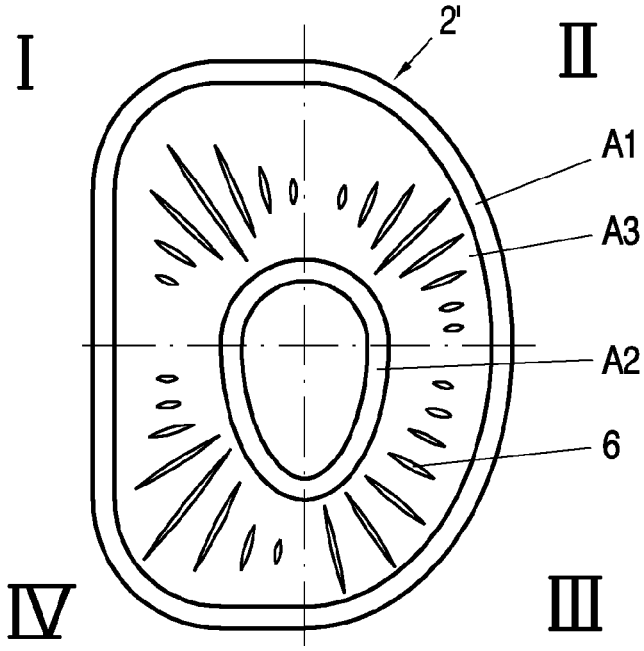
FIG. 5*b* shows another four embodiments of an inventive membrane.

FIG. 5*b* shows another set of four possible embodiments of an inventive membrane 2' comprising corrugations 6, each embodiment again in one of four quadrants I to IV. Here the kind of corrugations 6 is the same for all four quadrants I-IV. This Figure is to show that the invention does not only apply to rectangular speakers 1 with rectangular coils 3, but also to rectangular speakers 1 with cylindrical coils 3 (first quadrant I), to elliptical speakers 1 with cylindrical coils 3 (second quadrant II), to elliptical speakers 1 with elliptical coils 3 (third quadrant III), and finally, to rectangular speakers 1 with elliptical coils 3 (fourth quadrant IV).

Further variations of corrugations 6 are shown in FIGS. 6*a* to 6*f*, all showing an unrolling of a cross section along line L, sweeping a part of a straight section a, a curved section b, and a part of a straight section a. All FIGS. 6*a* to 6*f* show an arrangement of corrugations 6 that decrease the planar spring constant psc in and around the curved section b.

Figure 6A:
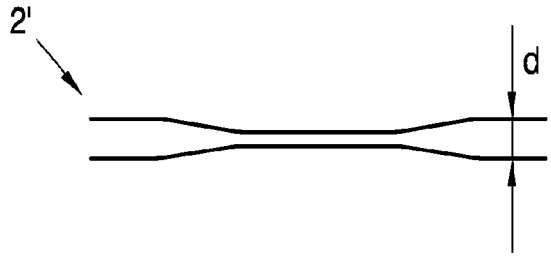
FIGS. 6*a* to 6*f* show variations of corrugations.
Figure 6B:
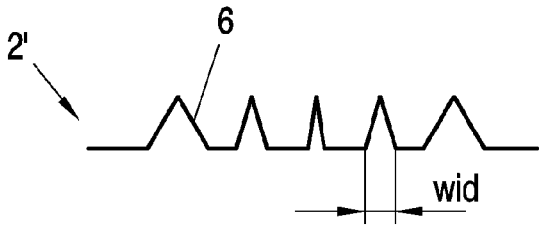
Figure 6C:
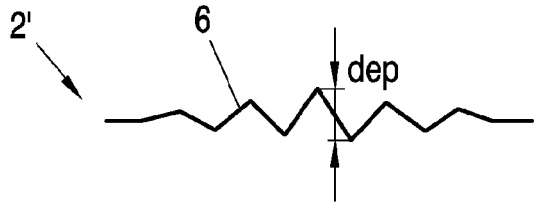
Figure 6D:
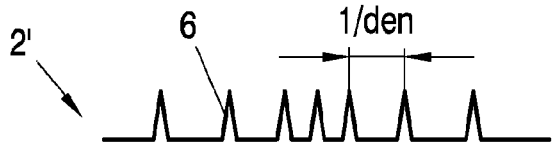
Figure 6E:
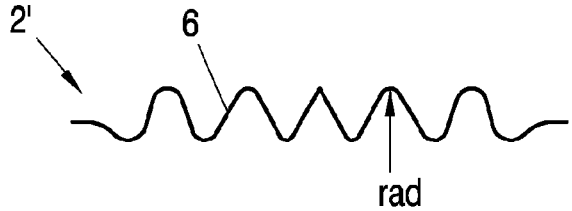
Figure 6F:
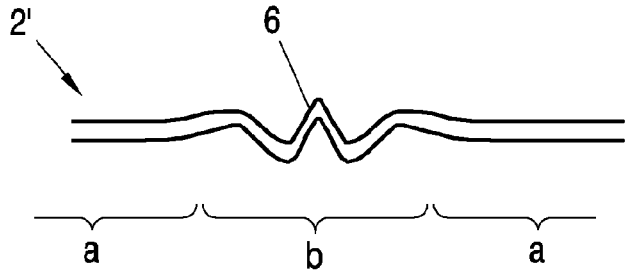

FIG. 6*a* simply shows that a membrane 2' may continuously be made thinner in the curved section b. FIG. 6*b* shows that the width wid of equally spaced corrugations 6 is varied. The smaller the width wid, the smoother the membrane 2', meaning that its planar spring constant psc is decreased. Yet another embodiment is shown in FIG. 6*c*. Here the depth dep of equally spaced corrugations 6 is varied for the same reason. FIG. 6*d* furthermore shows that the density den of corrugations may be varied so as to decrease the planar spring constant psc in the curved sections b. Here the space (reciprocal value of density den) between identical corrugations is different. Yet another possibility is shown in FIG. 6*e*, where the shape, in particular the radius rad of each corrugation 6, is varied. The smaller the radius rad, the lower the planar spring constant psc. FIG. 6*f* finally, shows a combination of all previous embodiments. Here the thickness of the membrane 2', the width wid, the depth dep, the density den as well as the radius rad of corrugations 6 is varied, so as to end in a further decrease of the planar spring constant psc in the curved section b.

It should be noted that the invention is not restricted to a single embodiment (FIG. 6*a*-FIG. 6*e*) or to the combination shown (FIG. 6*f*), but rather any combination of aforesaid embodiments is possible in principle. It is also imaginable that two opposed embodiments are combined. As an example a membrane 2' is mentioned, which is very thin in the corners or curved sections b after the ironing process. It is assumed that it is so thin that at least some translatory spring constants tsc in the curved sections b are smaller than in the straight sections a thus reversing the inventive object. In this special case the planar spring constants psc have to be increased in those areas. So taking the length len of corrugations 6 as an example and assuming that the minimum of the translatory spring constants tsc is situated in the middle of said curved sections b, the length len of the corrugations 6 is decreased around said middle, contrary to the arrangements shown in FIGS. 3*a* and 3*b*.

Figure 2A:
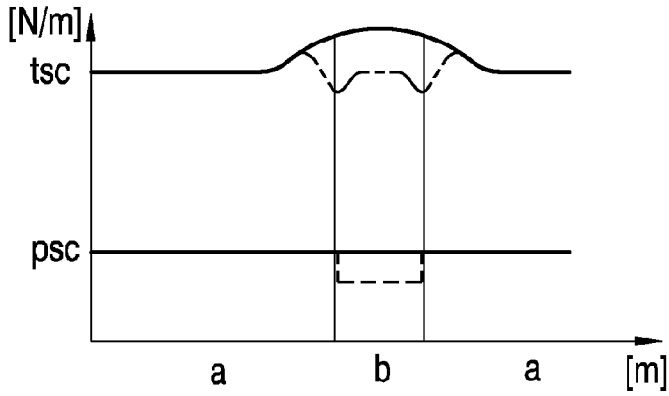
FIG. 2a (prior art)
FIG. 2*a* shows a graph of the planar and the translatory spring constant of prior art membranes.
Figure 2B:
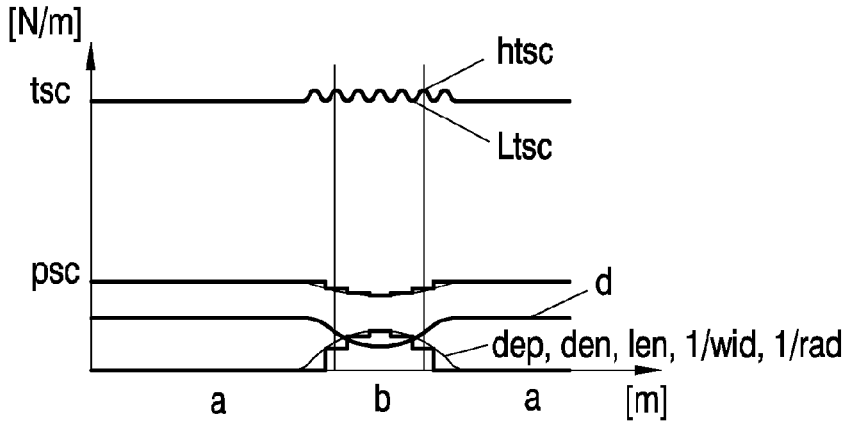
FIG. 2*b* shows the correlation between membrane parameters, the planar and the translatory spring constant for an inventive membrane.

To explain the consequences of such an arrangement of corrugations 6 shown in FIGS. 5*a*-5*b* and 6*a*-6*f*, reference is now made to FIG. 2*b*, which shows certain parameters of membranes 2' along a quarter of said line L similar to the diagram shown in FIG. 2*a*. Hence again half a straight section a of the long side of membrane 2', a curved section b, and half a straight section a of the small side of the membrane 2' is swept. FIG. 2*b* shows planar spring constant psc, which is in line direction DL, and the translatory spring constant tsc, which is in translatory movement direction DM.

To obtain a constant translatory spring constant tsc along line L as it is shown in FIG. 2*b*, the planar spring constant psc should have the graph shown, having a smooth depression in and around the curved section b. This means that the membrane 2' should be softer in the corners or curved sections b respectively. The exact graph has to be calculated by means of computer simulation using the finite elements method. Consequently, the density den, the depth dep, or the length len of corrugations 6 has to be increased in and around the curved section b. Alternatively, the width wid, the radius rad of corrugations 6 as well as the thickness of the membrane 2' has to be decreased in and around the curved section b. It should be noted that the diagram is simplified for the sake of brevity, meaning that of course the graphs for the depth dep and the length len for example might be different for obtaining the same graph for the planar spring constant psc. So the diagram shows general principles (e.g. the lower the depth dep is, the lower the planar spring constant psc is) but no exact values.

The solid thin lines show the optimum graph for a certain characteristic of a corrugation 6 or the membrane 2' respectively. Obviously the graph for the density den for example cannot continuously change as a corrugation 6 has a finite size. In other words: Only a certain finite number of corrugations 6 fit onto a membrane 2' so that only a certain finite number of changes of the planar spring constant psc may be achieved. As a first approximation, steps are shown in the graphs (solid bold lines). The only exception is the thickness of the membrane 2'. Of course it may continuously change. As a further consequence, also the translatory spring constant tsc does not have the same value in every single point of the line L. The graph rather shows small bumps, caused by the finite number of corrugations 6. So the translatory spring constants tsc along said line L are constant in the inventive sense, when they are macroscopically constant, meaning that bumps cannot be avoided on the grounds addressed above. Concluding the translatory spring constants tsc has to stay between a certain lowest translatory spring constant ltsc and a certain highest translatory spring constant htsc.

Figure 2C:
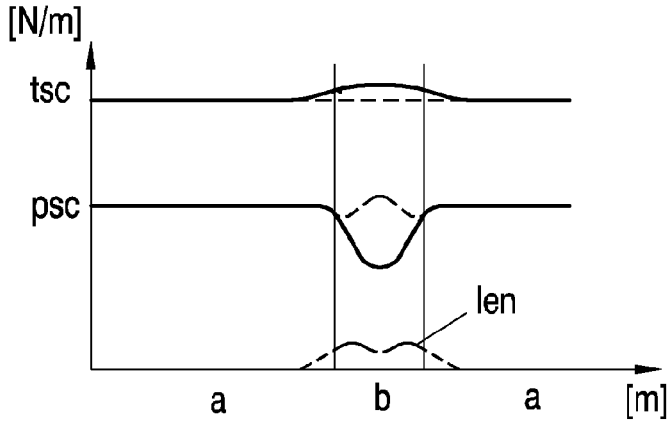
FIG. 2*c* is a diagram similar to FIG. 2*b* for another inventive membrane.

FIG. 2*c* now shows another diagram similar to that shown in FIG. 2*b*. Here the desired graph for the planar spring constant psc which would be necessary for obtaining a constant translatory spring constant tsc shows a dramatic depression in the curved section b (solid line). It is now assumed, that even a combination of every possibility to decrease the planar spring constant psc is not sufficient to obtain the desired graph. Hence at least flat slopes for the graph of the translatory spring constant tsc are aimed at. The result can be seen in FIG. 2*c*. Indeed the translatory spring constants tsc (solid line) are not constant but the changes are far smoother than those of a prior art speaker as shown in FIG. 2*a*.

FIG. 2*c* furthermore shows the case of a membrane 2', which is too thin in the corners due to the ironing process as addressed above, where it is assumed that the minimum of the translatory spring constants tsc is situated in the middle of said curved sections b. The desired graph for the planar spring constant psc (dashed line) shows two depressions around one elevation. Hence the length len of corrugations 6 (dashed line) slowly increases coming from the straight sections a but decreases again in the middle of the curved section b. As a result the translatory spring constants tsc (dashed line) are constant along the line L. It should be noted that in FIG. 2*c* as well as in FIG. 2*a* any steps, caused by the finite number of corrugations 6, are omitted for the sake of brevity. However, in reality finite corrugations 6 cause a ripple in the graph of the translatory spring constants tsc also in these examples.

Figure 3:
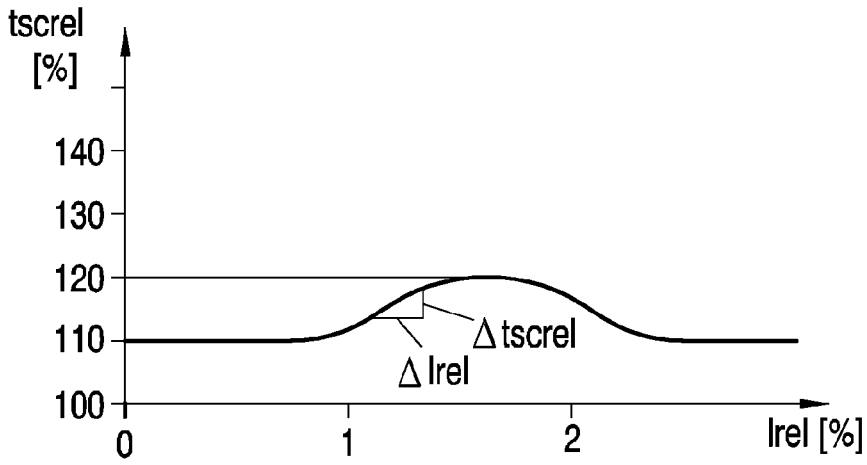
FIG. 3 shows how a differential slope of a relative translatory spring constant over a relative length may be calculated.

FIG. 3 now shows how a differential slope of a relative translatory spring constant tscrel over said relative length lrel may be calculated. First, a relative translatory spring constant tscrel is defined as the ratio between a translatory spring constant tsc and the lowest translatory spring constant ltsc. Therefore, the x-axis crosses the y-axis at 100% which means that this is the lowest value of a translatory spring constant tsc along a line L. It is further assumed that the bump shown is the highest along said line. So also the ratio between highest translatory spring constant htsc and lowest translatory spring constant ltsc, here 120%, is shown in FIG. 3. Second, a relative length lrel of said line L is defined as the ratio of a length and the total length of said line L. FIG. 3 only shows a small cutout of about 2.5% of the overall length of said line L. Now the differential slope of said relative translatory spring constant tscrel over said relative length lrel may be calculated. Therefore the difference of two relative translatory spring constants Δtscrel and the difference of two relative length Δlrel is taken to calculate the differential slope $$\frac{\Delta tscrel}{\Delta lrel} = \frac{\frac{tsc2}{ltsc} - \frac{tsc1}{ltsc}}{\frac{l2}{ltot} - \frac{l1}{ltot}} = \frac{tsc2 - tsc1}{l2 - l1} \cdot \frac{ltot}{ltsc}$$

wherein tsc1 and tsc2 are two (absolute) values of the translatory spring constant tsc, ltsc is the lowest translatory spring constant ltsc as mentioned before, l1 and l2 are two (absolute) values of a length and ltot is the total length of said line L. In the example shown the differential slope is about $$\frac{\Delta tscrel}{\Delta lrel} = \frac{4\%}{0.2\%} = 20$$

It should be noted at this point that the graph of FIG. 3 is a macroscopic view of the relative translatory spring constant tscrel, which means that variations within a corrugation 6 are not shown. For example discrete values each in the middle of a corrugation 6 are taken and interpolated in between, thus resulting in a graph shown in FIG. 3. Similarly, discrete values at the highest or lowest elevation of each corrugation 6 may be taken.

Figure 4:
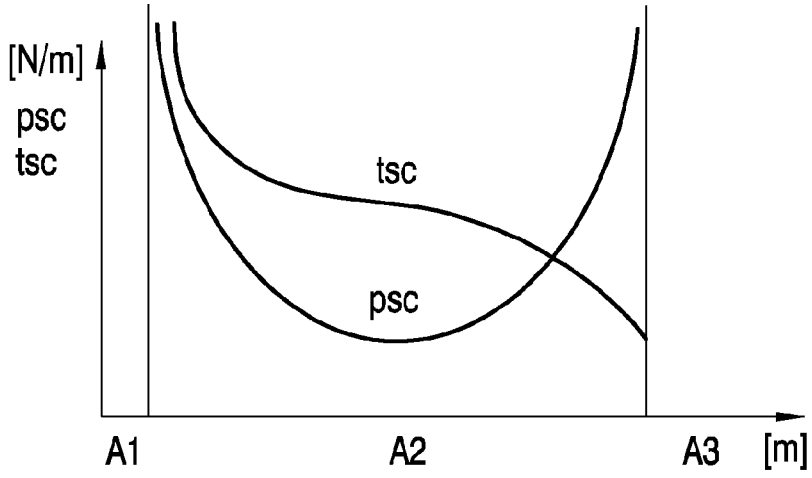
FIG. 4 shows the planar and the translatory spring constant along a line joining first area and second area.

FIG. 4 finally, shows a diagram for the planar spring constant psc and the translatory spring constant tsc along a joining line, joining first area A1 and second area A2. In the following example it is assumed that said joining line is perpendicular to the line L, which encompasses the second area A2. The first area A1 is the mounting portion of the membrane 2', where the membrane 2' is joined to a housing 5 and the second area A2 is the portion of the membrane 2', where the membrane 2' is joined to a coil 3. As the housing 5 and the coil 3 are assumed to be quite stiff, at least compared to the membrane 2', the planar spring constant is nearly infinite at the border area between first A1 and third area A3 or second A2 and third area A3 respectively. In between it is softer and has a certain value, which is highly influenced by the measures taken as described before (see FIGS. 5*a*-5*b*, 6*a*-6*f*). The translatory spring constant tsc is infinite as well at the border between first A1 and third area A3 as the third area A3 may not move in relation to the first area A1 at the border. Over the joining line the value for the translatory spring constant tsc decreases and reaches a certain value at the border between second A2 and third area A3. This value is relevant for designing the coil 3, as a current through said coil within the magnet system 4 causes a force to occur which in turn causes a movement to occur of the second area A2 according to said value of the translatory spring constant tsc. Accordingly, the translatory spring constants tsc which are aimed to be constant or to have substantially flat, mutual changes may be at the border between second A2 and third area A3 and not necessarily on a line L, where the planar spring constant psc is varied.

It should be noted that—although reference is mostly made to speakers—the invention similarly relates to microphones. The only difference it the way of action and reaction. Whereas a current causes sound waves in the case of a speaker, a sound wave causes a current in the case of a microphone. But the kinematic and mechanic principles are the same for both devices.

It finally, should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A rectangular membrane for an electroacoustic transducer, the membrane comprising:

a first area;

a second area, which is arranged for translational movement relative to the first area; and a third area, which connects the first area and the second area, the third area including straight sections and curved sections, wherein local, planar spring constants along a closed line, which has straight sections and curved sections corresponding to the straight and curved sections of the third area and which is arranged within the third area encompassing the second area, each in a direction of the line are determined in such a way that local, translational spring constants along the line each in a direction of the translational movement are at least one of substantially constant and exclusively have substantially flat, mutual changes.

2. The membrane as claimed in claim 1, wherein local, planar spring constants along each closed line, which is arranged within said third area encompassing said second area, each in the direction of said line are determined in such a way that local, translational spring constants along said line each in a direction of said translational movement are at least one of substantially constant and exclusively have substantially flat, mutual changes.

3. The membrane as claimed in claim 1, wherein a ratio between a highest translational spring constant and a lowest translational spring constant does not exceed 1.5.

4. The membrane as claimed in claim 1, wherein a relative translational spring constant is defined as a ratio between a translational spring constant and a lowest translational spring constant, wherein a relative length is defined as a length and a total length of said line, and wherein a differential slope of said relative translational spring constant over said relative length does not exceed 100 at any point of said line.

5. The membrane as claimed in claim 1, further comprising a plurality of corrugations, wherein the planar spring constants are determined by variation of a shape of the corrugations.

6. The membrane of claim 5, wherein a length of the corrugations varies within the curved sections of the third area of the membrane.

7. The membrane of claim 6, wherein the corrugations start at an inner border of the third area.

8. The membrane of claim 6, wherein the corrugations are arranged in a middle of the third area.

9. The membrane of claim 5, wherein a density of the corrugations varies within the curved sections of the third area of the membrane.

10. The membrane of claim 5, wherein a width of the corrugations varies within the curved sections of the third area of the membrane.

11. The membrane of claim 5, wherein a depth of the corrugations varies within the curved sections of the third area of the membrane.

12. The membrane of claim 5, wherein a radius of the corrugations varies within the curved sections of the third area of the membrane.

13. The membrane of claim 1, wherein a thickness of the membrane varies within the curved sections of the third area of the membrane.

14. A transducer comprising a membrane as claimed in claim 1.

15. A device comprising a transducer as claimed in claim 14.

* * * * *